US009327302B2

(12) United States Patent
Ernst et al.

(10) Patent No.: US 9,327,302 B2
(45) Date of Patent: May 3, 2016

(54) THERMAL COATING OF A COMPONENT STACK AND OF COMPONENT STACKS

(71) Applicant: Sulzer Metco AG, Wohlen (CH)

(72) Inventors: Peter Ernst, Stadel b. Niederglatt (CH); Bernd Distler, Elmont, NY (US)

(73) Assignee: OERLIKON METCO AG, Wohlen, Wohlen (CH)

( * ) Notice: Subject to any disclaimer, the term of this patent is extended or adjusted under 35 U.S.C. 154(b) by 21 days.

(21) Appl. No.: 14/028,779

(22) Filed: Sep. 17, 2013

(65) Prior Publication Data

US 2014/0079890 A1 Mar. 20, 2014

(30) Foreign Application Priority Data

Sep. 19, 2012 (EP) ..... 12185018

(51) Int. Cl.

| | |
|---|---|
| ***B05D 1/08*** | (2006.01) |
| ***B05B 15/04*** | (2006.01) |
| ***B05D 1/02*** | (2006.01) |
| ***C23C 4/00*** | (2016.01) |
| ***C23C 4/02*** | (2006.01) |
| ***C23C 4/04*** | (2006.01) |
| ***C23C 4/12*** | (2016.01) |

(52) U.S. Cl.

CPC . *B05B 15/04* (2013.01); *B05D 1/02* (2013.01); *C23C 4/005* (2013.01); *C23C 4/02* (2013.01); *C23C 4/04* (2013.01); *C23C 4/12* (2013.01); *C23C 4/127* (2013.01)

(58) Field of Classification Search

CPC ..... B05B 15/04; B05D 1/02; C23C 4/127; C23C 4/12

USPC ..... 427/476, 105, 233, 236, 446

See application file for complete search history.

(56) References Cited

U.S. PATENT DOCUMENTS

| | | | | |
|---|---|---|---|---|
| 4,866,241 | A * | 9/1989 | Doherty et al. | 219/121.47 |
| 8,234,785 | B2 | 8/2012 | Guerreiro | |
| 2009/0174150 | A1 | 7/2009 | Smith et al. | |
| 2010/0043742 | A1* | 2/2010 | Erdmann et al. | 123/197.3 |
| 2010/0050432 | A1* | 3/2010 | Guerreiro | 29/888.09 |

FOREIGN PATENT DOCUMENTS

| | | | |
|---|---|---|---|
| DE | 2314348 | A1 | 9/1974 |
| EP | 0498479 | A1 | 8/1992 |
| EP | 1900473 | A1 | 3/2008 |
| EP | 2029317 | B1 | 8/2010 |
| GB | 2262945 | A | 7/1993 |
| GB | 2313171 | A | 11/1997 |
| JP | 54162635 | A | 12/1979 |
| WO | 99/05339 | A1 | 2/1999 |
| WO | 2004097272 | A1 | 11/2004 |

OTHER PUBLICATIONS

European Search Report of EP patent application 12185018, Mar. 5, 2013.

* cited by examiner

*Primary Examiner* — Dah-Wei D Yuan
*Assistant Examiner* — Nga Leung V Law
(74) *Attorney, Agent, or Firm* — Greenblum & Bernstein, P.L.C.

(57) ABSTRACT

A component stack is coated such that, during a first coating pass, a first angle (α) is formed between the first stack opening surface and the coating beam and, during a second coating pass, a second angle (β) is formed between the first stack opening surface and the coating beam, wherein the first angle (α) and the second angle (β) are formed in opposite directions relative to the first stack opening surface.

15 Claims, 5 Drawing Sheets

STAND DER TECHNIK

THERMAL COATING OF A COMPONENT STACK AND OF COMPONENT STACKS

CROSS-REFERENCE TO RELATED APPLICATIONS

Figure 1:
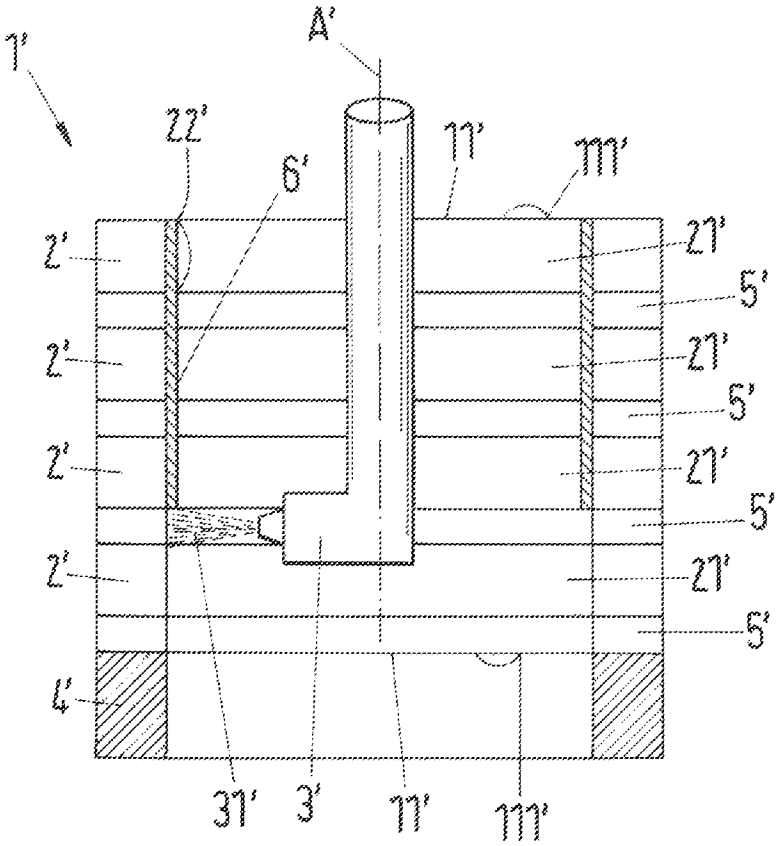

The present application claims priority under 35 U.S.C. §119 of European Patent Application No. 12185018.4 filed on Sep. 19, 2012, the disclosures of which is expressly incorporated by reference herein in its entirety.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

A method for the thermal coating of a component stack which includes a component is known from EP 2 029 317 B1 wherein the component has a continuous component opening and can be a bearing component, in particular a connecting rod made from a formed part. In a bearing component, the continuous component opening is formed by a bearing floor and a bearing cover wherein an inner peripheral surface, or bounding surface, of the component opening includes a divided component seat, in particular a bearing seat. Furthermore, a component coating made from a layer material, for example, a component seat for housing a shaft is formed at the inner bounding surface. In this method, the component is aligned with respect to a stack axis such that the component stack has a continuous stack opening, wherein the stack opening includes a first stack opening surface and a second stack opening surface and the first stack opening surface and the second stack opening surface are arranged along the stack axis. During the coating process an inner bounding surface of the component opening is thermally coated from the inside by a coating beam by means of a thermal spray apparatus.

The aim of this known method is the coating of the inner bounding surface of the components which are arranged as a component stack. The desired component coating in this connection should have a smooth and continuous layer extent and be formed having regular or even layer thicknesses. The formation of such a component coating by this method known from the prior art is, however, only possible if the angle between the coating beam and the inner bounding surface is not too flat and is ideally approximately perpendicular to the inner bounding surface. However, since the angle of the coating beam is fixed, this method only works for components whose inner bounding surface, for example, has a straight inner cross-section. This is different for components whose inner bounding surfaces have an inner cross-section having a non-uniform or a convex geometry. For these components, the angle of the coating beam is too flat in part regions such that a smooth and continuous layer extent and a component coating having regular or even layer thicknesses are not formed.

SUMMARY

For this reason the object of the invention is to provide an improved method for the thermal coating of a component stack and an improved apparatus having a component stack.

This object is satisfied in accordance with the invention by a method having the features of the independent claim 1 and by an apparatus having the features of the independent claim 12.

The invention therefore relates to a method for the thermal coating of a component stack wherein, in accordance with the invention, the component stack is coated such that, during a first coating pass, a first angle is formed between the first stack opening surface and the coating beam and, during a second coating pass, a second angle is formed between the first stack opening surface and the coating beam. In this connection the first angle and the second angle are formed in opposite directions relative to the first stack opening surface.

An advantage of the method is that it enables the solution in accordance with the invention to coat components whose inner peripheral surfaces have a non-uniform inner cross-section along the stack axis with a substantially smooth component coating having a uniform layer extent and even and regular layer thicknesses. Components having an inner peripheral surface whose inner cross-section have a non-uniform extent are to be understood as geometries having, for example, convexly curved or bulged geometries in the direction of the stack axis.

In this method the first and the second angle are formed between the first stack opening surface and the coating beam. Since the coating beam is formed, for example, as a cone or an ellipsoid, the central axis of the cone or the ellipsoid is preferably used as a reference line for the coating beam such that the first and the second angle are formed between the central axis of the coating beam and the first stack opening surface. In this connection, the first and the second angle can be different or the same in value, depending on the application.

In order to coat the component, a thermal spray apparatus, in particular a rotating plasma torch, is guided along the stack axis through a stack opening surface such that, one after another, the inner bounding surfaces of all components are coated with a component coating. In this connection the coating of the component stack is preferably applied by a thermal spray method, in particular by flame spraying, high-speed flame spraying, plasma spraying or another thermal spray method known from the prior art.

A coating pass is to be understood as a single, complete passing of the thermal spray apparatus through the component stack and back, this means from the first to the second stack opening and back. The first and second coating pass advantageously correspond to a single, complete passing wherein, depending on the application, the first and second coating passes can also include the repeated passing of the thermal spray apparatus through the component stack and back.

The substantially smooth component coating having a uniform layer extent and even layer thickness is formed in accordance with the invention such that, during the first coating pass, the coating beam, which forms the first angle relative to the first stack opening surface, is incident on a part of the non-uniform inner bounding surface approximately perpendicular and therefore only the part of the inner bounding surface is coated with a proper layer thickness whose surface elements are aligned approximately perpendicular to the coating beam after the first coating pass. During the second coating pass, the coating beam forms the second angle relative to the stack opening surface, which second angle is formed with respect to the first angle relative to the first stack opening surface in opposite directions, and the surface elements of the non-uniform inner bounding surface are now coated and are now aligned approximately perpendicular to the coating beam. An advantage of the method in accordance with the invention is therefore that, due to the two coating passes having both angles, the angle at which the coating beam is incident is not too flat, this means is incident approximately perpendicular to all surface elements for components whose inner bounding surfaces have an inner cross-section having, for example, a non-uniform or a convex geometry.

In this method, the change of the first or second angle is realized, for example, by means of a change of the angle of a torch, of a pistol or of a nozzle at the torch or at the pistol relative to the thermal spray apparatus.

In an embodiment of the invention, the second angle is formed in such a manner that the component stack is rotated about a first pivot of the stack axis after the first coating pass such that the first stack opening surface and the second stack opening surface have an arrangement along the stack axis after rotation opposite with respect to the arrangement before the rotation.

The advantage of this embodiment is that the first angle corresponds to the second angle, i.e. the first angle is fixed throughout the entire coating process and the second angle is formed only by rotating the component stack between the first and the second coating pass such that no further changes of the settings of the angles are necessary. An opposite arrangement of the first stack opening surface and the second stack opening surface along the stack axis means that the component stack is rotated such that the thermal spray apparatus is merely displaced along the stack axis and, for example, is guided during the first coating pass through the first stack opening surface and during the second coating pass through the second stack opening surface. In this connection, the first pivot can be located at an arbitrary point at the stack axis.

In a further embodiment, the second angle is formed in such a manner that the thermal spray apparatus is rotated about a second pivot at the stack axis after the first coating pass. In contrast to the previous embodiment, the thermal spray apparatus is advantageously rotated instead of the component stack in this embodiment. In this connection, the second pivot can be located at an arbitrary point at the stack axis.

In a third preferred embodiment, the thermal spray apparatus is guided through the first stack opening surface during the first coating pass and during the second coating pass. In this connection, the first angle and the second angle are advantageously formed between the first and the second coating pass, for example, by means of a change of the angle, such that neither the component stack nor the thermal spray apparatus are rotated. The change of the first or the second angle is realized in this embodiment, for example, by means of the change of the angle of a torch, of a pistol or of a nozzle at a torch or a pistol relative to the thermal spray apparatus.

In a further embodiment of the invention, a first thermal spray apparatus having a first coating beam and a second thermal spray apparatus having a second coating beam are provided, and the first coating pass and the second coating pass take place simultaneously. In this embodiment, two thermal spray apparatus are thus provided, wherein the formation of the first angle by means of the first thermal spray apparatus and the second angle by means of the second thermal spray apparatus occurs simultaneously such that the first and the second coating pass take place simultaneously. An advantage of this embodiment is that the coating of the inner bounding surface can take place in one coating pass. The first and the second thermal spray apparatus can, for example, simultaneously be guided along the stack axis from the first stack opening surface to the second stack opening surface, and the first thermal spray apparatus coats at the first angle and, during displacement along the stack axis from the second stack opening surface to the first stack opening surface, the second thermal spray apparatus coats at the second angle. Simultaneous coating by the first and the second thermal spray apparatus is also possible as a variation.

The first angle and the second angle preferably amount to between 0 and 30 degrees, preferably to between 5 and 15 degrees and particularly preferred to 10 degrees. Advantages of the alignment of the coating beam in these angle ranges are that, on the one hand, it is prevented that the coating beam is incident on the inner bounding surfaces at too flat of an angle and, on the other hand, that by the coating of the inner bounding surface along the stack axis at two different angles a coating with a uniform layer extent and even layer thickness is generated at all points of the inner bounding surface. This measure is particularly advantageous if an inner cross-section of the inner bounding surface of the component opening is formed non-uniform, in particular convexly curved, along the stack axis. Particularly advantageously the coating beam is ideally incident on the inner bounding surface at almost all points for components having an inner bounding surface whose inner cross-section is convexly curved, due to the symmetry of the components.

In an embodiment of the invention, the component stack is advantageously rotated about the stack axis on coating and/or the thermal spray apparatus on coating, in particular a plasma torch, is rotated. Therefore, depending on the embodiment, either the thermal spray apparatus or the component stack can be rotated in one direction, or both the component stack and the thermal spray apparatus can be rotated, preferably in opposing directions. Specifically, the component stack is arranged on a holder. Should a rotation of the thermal spray apparatus about the stack axis with a simultaneously stationary component stack not be possible, it is advantageous that the apparatus including the component stack or the component stack and the holder is arranged so that it can be rotated about the thermal spray apparatus. In another embodiment, another advantageous measure can be a simultaneous rotation of the thermal spray apparatus and the apparatus including the component stack or the component stack and the holder whereby, for example, components which have a complex geometry are coated more quickly and efficiently and/or a better component coating is formed.

A spacer is advantageously provided between the components of a component stack such that the components are arranged spaced apart. Advantageously the components can be cleanly separated after the completion of the coating pass in this manner without any damage. The spacer is formed, for example, in the form of a disk, in particular, in the form of a disk having a round or an oval spacer opening, wherein an inner cross-section and/or an outer cross-section of the spacer can be formed so that it is polygonal or concavely curved or convexly curved along the stack axis. Alternatively or additionally, the spacer can also specifically be formed in the form of a disk having a round or an oval outer contour. Depending on the embodiment, the spacer opening and the inner cross-section of the spacer can have a different form in the direction of the stack axis such that they may be advantageously adapted to each application. In particular, the spacers can be formed as a part of the component, which is particularly efficient for industrial manufacturing methods since an additional spacer separate from the component can be dispensed with.

In an embodiment the component is a bearing component and/or the inner bounding surface is configured as a component seat surface, in particular for the storage of a shaft. Such bearing components are known, for example, as connecting rods having a small connecting rod eye, a shaft and a large connecting rod eye, wherein the large connecting rod eye generally includes a divided component seat for the storage of the connecting rod on a crank shaft. Bearing components and connecting rods are installed in large numbers, for example, in reciprocating internal combustion engines for passenger vehicles and commercial vehicles, but also in motors for ships or in other machines wherein a linear movement must be translated into a rotational movement or vice versa.

The invention further relates to a component stack which, as described above in detail in the discussion of the method in accordance with the invention, can be coated such that, during a first coating pass, a first angle can be formed between the first stack opening surface and the coating beam and during the second coating pass, a second angle can be formed between the first stack opening surface and the coating beam. The first angle and the second angle can in this connection be configured in opposite directions relative to the first stack opening surface.

Furthermore, the apparatus in accordance with the invention includes a holder for the component stack wherein at least two and preferable ten or more bearing components are arranged on the holder in the form of a stack. Especially in industrial manufacturing wherein large quantities of components must be manufactured as efficiently and inexpensively as possible, the holder makes it possible, to arrange multiple bearing components in the form of a stack on the holder at once on the coating of components and, in this way, to coat the components in a single step. Furthermore, the components can be easily removed from the holder after the coating.

As an advantageous measure, the component stack is arranged such that it can be rotated with respect to a thermal spray apparatus and/or the thermal spray apparatus can be rotated about the stack axis.

FIGURES

Figure 2:
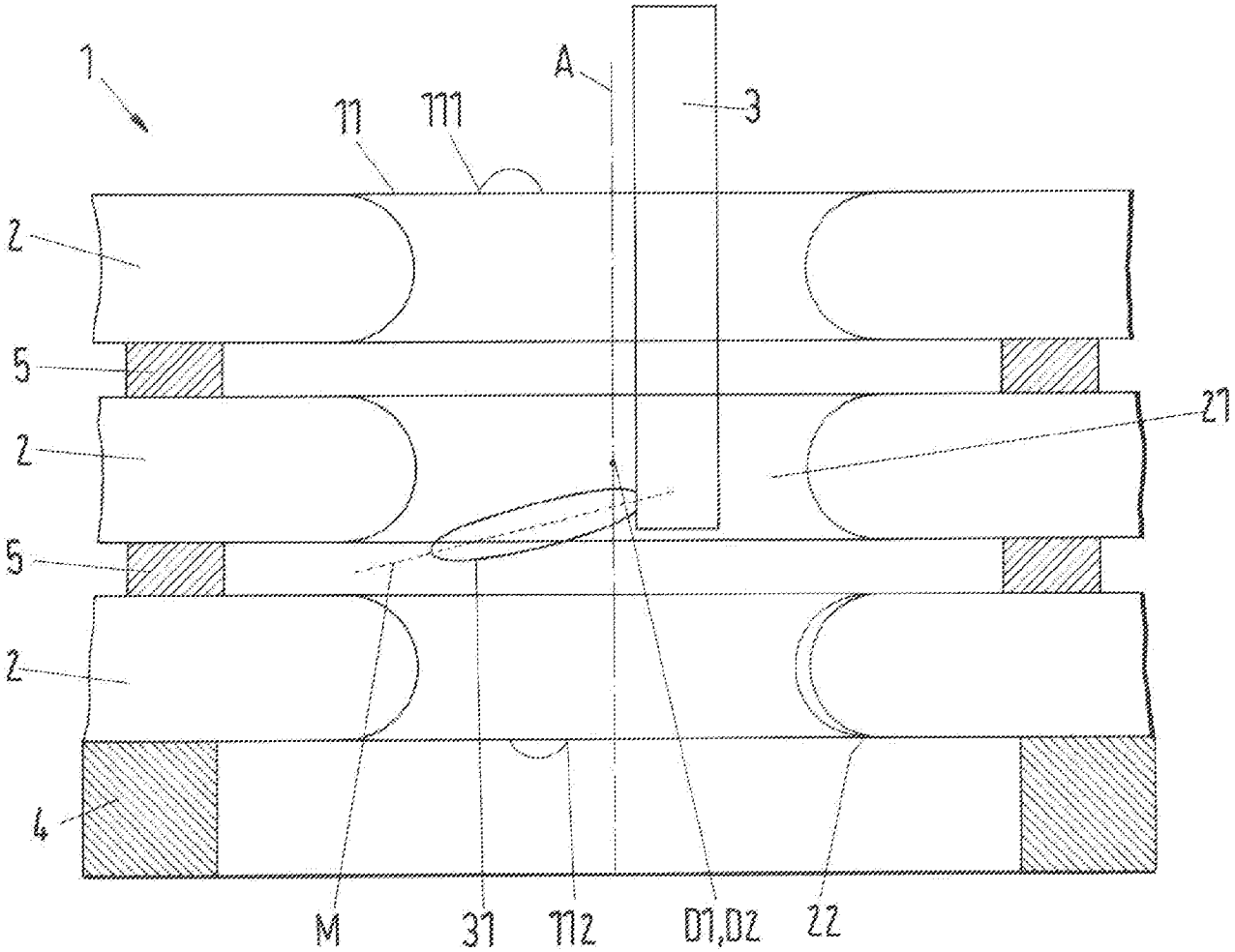
Figure 3A:
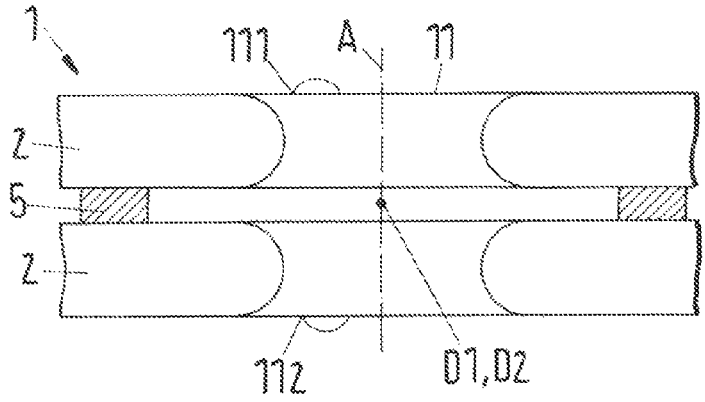
Figure 3B:
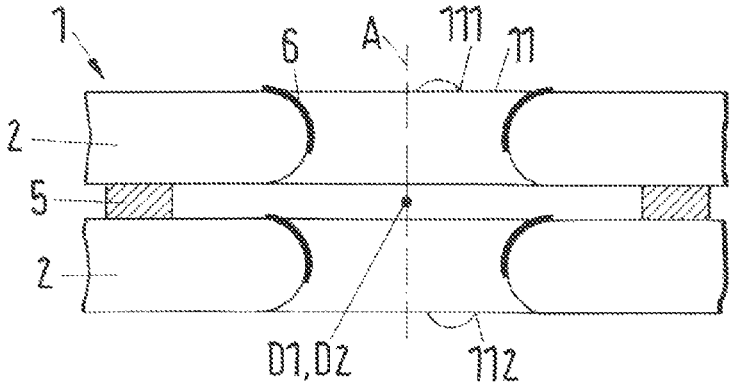
Figure 3C:
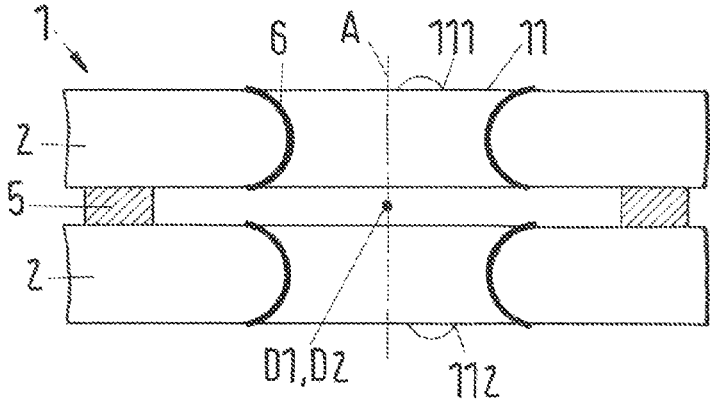
Figure 4:
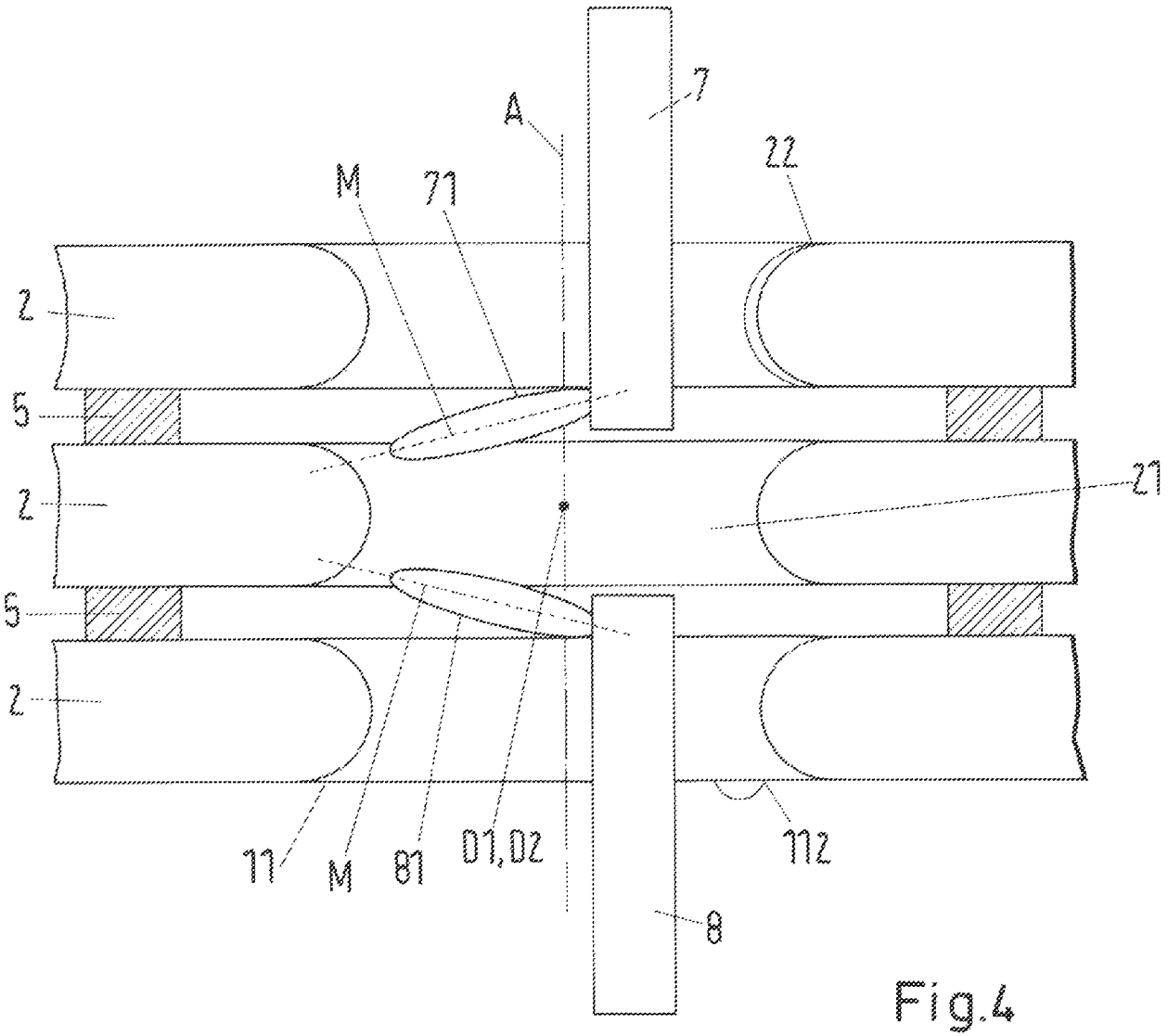

In the following, the invention is described in greater detail by means of the Figures. There are shown in a schematic illustration:

FIG. 1 an apparatus having a component stack known from the prior art;

FIG. 2 an apparatus having a component stack having an arrangement of the components in accordance with the invention;

FIG. 3*a-c* coated components after different coating passes in the method in accordance with the invention;

FIG. 4 an embodiment of the apparatus having a component stack having an arrangement of the components in accordance with the invention;

FIG. 5*a-h* a component stack having an arrangement of the component in accordance with the invention and illustration of the first and second angles.

DETAILED DESCRIPTION

It applies in the following description of the Figures that all reference numerals which refer to features of the examples from the prior art are provided with an inverted comma and all reference numerals which refer to features of embodiments of the invention are indicated without inverted commas.

FIG. 1 shows an apparatus having a component stack known from the prior art. A component stack 1' made from arranged components 2' having component openings 21', for example, a bearing component, in particular a connecting rod, is illustrated. Spacers 5' are provided between the components 2' which are formed, for example, as disks so that the components 2' can be separated after completion of the coating pass. The components 2' and the spacers 5' are stacked on top of one another on a holder 4' such that all inner hounding surfaces 22' of the component openings 21', for example, large connecting rod eyes, can be coated in one coating pass by means of a rotating thermal spray apparatus 3' known in the art, for example, a plasma torch. In this connection the thermal spray apparatus 3' rotates about the stack axis A' during the coating pass and is guided in accordance with the illustration in a perpendicular direction along the stack axis A' such that, one after another, the inner bounding surfaces of all components 2' can be coated with a component coating 6'.

Due to the manner wherein the components 2' having the respective components openings 21' and the holder 4' are stacked, a homogenous component coating 6' forms along the stack axis A' in a stack opening 11' of the component stack 1'. A uniform component coating 6' is to be understood as a component coating 6', which is formed at the components 2', having a substantially smooth component coating with a uniform layer extent and even layer thicknesses along the entire component stack 1' in the direction of the stack axis A'.

During the coating pass, the angle between coating beam 31', that is, a center axis of the coating beam 31', and the stack opening surface 111' is approximately equal to 0 degrees, as well as perpendicular to the stack axis A', so that assuming that the inner bounding surface 22' of the components 2' has a straight inner cross-section, the coating beam 31' is incident approximately perpendicular on the inner bounding surface 22' to be coated.

In the following, an apparatus of a component stack 1 having an arrangement of components 2 in accordance with the invention is introduced by means of FIG. 2.

The apparatus having a component stack 1 schematically illustrated in FIG. 2 shows a total of three components 2 having a continuous component opening 21, for example, three bearing components or three connecting rods, which are stacked on top of one another on a holder 4 in the form of a component stack 1 such that an inner bounding surface 22 of the components 2 can be coated, one after another, by means of the thermal spray apparatus 3.

The three components 2 are aligned with respect to a stack axis A in such a way that the component stack 1 has a continuous stack opening 11. In this connection, the stack opening 11 includes a first stack opening surface 111 and a second stack opening surface 112 wherein the first stack opening surface 111 and the second stack opening surface 112 are arranged along the stack axis A.

The thermal spray apparatus 3, illustrated in this example as a plasma torch having a coating beam 31 which includes a center axis M, is guided through the first stack opening surface 111 and/or the second stack opening surface 112 to the inner bounding surfaces 22 of the component openings 21, and in the operating state the inner bounding surfaces 22 are thermally coated from the inside. During the coating pass, the plasma torch 3 can rotate about the stack axis A and in this connection is guided, in accordance with the illustration, in a perpendicular direction along the stack axis A so that in all components all inner bounding surfaces 22, for example, large connecting rod eyes can be coated, one after another, with a component coating 6. In a variation, the component stack 1 illustrated in FIG. 2 can be arranged so that it can be rotated with respect to the plasma torch 3.

The inner cross-section of the inner bounding surfaces 22 of the three components illustrated in FIG. 2, which components are arranged along the stack axis A as a component stack include a non-uniform, namely a convexly curved, extent. In this arrangement the inner bounding surfaces can be coated such that, during a first coating pass, a first angle can be formed between the first stack opening surface 111 and the coating beam 31 and, during the second coating pass, a second angle can be formed between the first stack opening surface 111 and the coating beam 31. As shown in various drawing figures, the first and second angles are non-perpendicular to the stack axis A.

Furthermore, a first pivot D1 and a second pivot D2 are shown in FIG. 2 about which, in a particularly advantageous embodiment, the component stack 1 is rotated at the stack axis A after the first coating pass. During this rotation, the component stack is rotated such that the first stack opening surface 111 and the second stack opening surface 112 have an arrangement along the stack axis A after rotation opposite with respect to the arrangement before the rotation. If the component stack 1 is not rotated, but rather the thermal spray apparatus 3 is rotated, then the rotation occurs about the second pivot D2. In this connection the apparatus includes a holder 4 for the component stack 1 so that the components 2 are fixed during the rotation and the coating. Spacers 5 are provided between the components 2 of the component stack 1 so that the components 2 are arranged spaced apart in the component stack 1.

In FIG. 3*a*-3*c* components can be seen after different coating passes in the method in accordance with the invention. All three figures show a component stack 1 having two components 2 which are aligned with respect to the stack axis A and are spaced apart by means of spacers 5. The pivot D1 about which the component stack is rotated can be seen at the stack axis A.

As shown in FIG. 2, the components 2 are aligned with respect to a stack axis A such that the component stack 1 has a continuous stack opening 11 wherein the stack opening 11 includes a first stack opening surface 111 and a second stack opening surface 112, and the first stack opening surface 111 and the second stack opening surface 112 are arranged along the stack axis A. The extent of the inner cross-section of the inner bounding surface 22 is non-uniform or rather the inner bounding surface 22 of the embodiment at hand is formed convexly curved along the stack axis A.

In detail, FIG. 3*a* shows a component stack 1 before the first coating pass. FIG. 3*b* shows a component stack 1 having two components 2 after the first coating pass. The inner bounding surface 22, which is only partially coated, can clearly be seen. The component coating 6 formed after this first coating pass is irregular and includes uneven layer thicknesses since the coating beam is only incident on a part of the inner bounding surface of the continuous component opening and therefore only this part of the inner bounding surface is coated after the first coating pass. Only the surfaces which have an orientation approximately perpendicular to the direction of the coating beam having the first angle and at which the coating beam is incident at not too flat an angle are coated in this first coating pass.

FIG. 3*c* shows the component stack 1 after a second coating pass in the method in accordance with the invention.

In this second coating pass during which the second angle is formed with respect to the first angle in an opposite direction relative to the first stack opening surface, the parts of the non-uniform inner bounding surface are coated which were not aligned approximately perpendicular to the direction of the coating beam in the previous coating pass. The component coating 6 is shown in FIG. 3*c* as a substantially smooth component coating 6 having a uniform layer extent and even layer thicknesses.

FIG. 4 corresponds substantially to FIG. 2; however, a further embodiment of the invention is illustrated. The difference to FIG. 2 lies in the fact that a first thermal spray apparatus 7 having a first coating beam 71 and a second thermal spray apparatus 8 having a second coating beam 81 are provided. In this embodiment, the formation of the first angle (not shown) takes place by means of the first thermal spray apparatus 7 and the formation of the second angle (not shown) simultaneously occurs by means of the second thermal spray apparatus 8 and the first and the second coating pass take place simultaneously.

FIG. 5 *a-b* correspond substantially to FIG. 2 and show component stacks having an arrangement of the components in accordance with the invention and having an illustration of the first and the second angles.

Figure 5A:
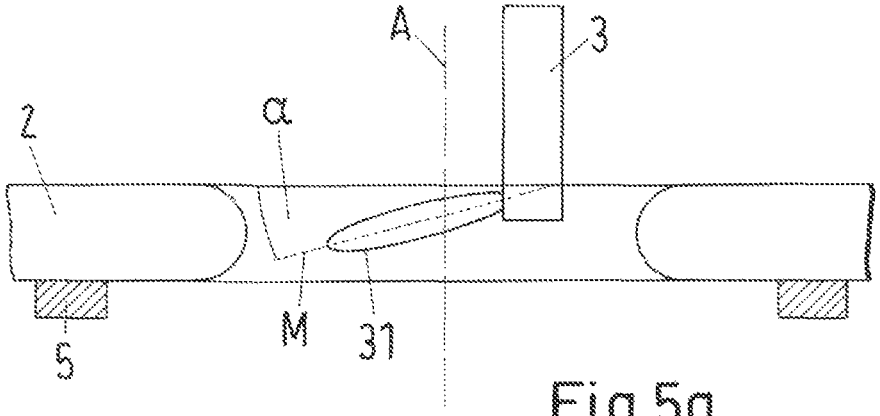
Figure 5B:
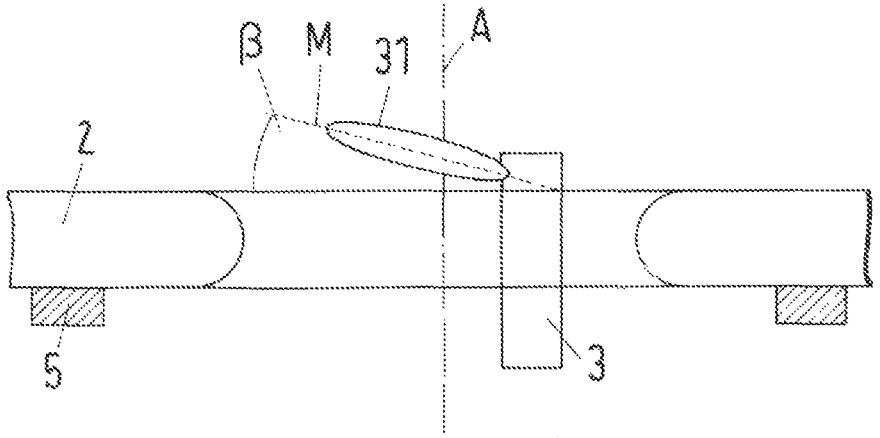

In FIG. 5*a* is shown how a first angle $\alpha$ is formed between the first stack opening surface 111 and the coating beam 31 and in FIG. 5*b* how a second angle $\beta$ is formed between the stack opening surface 111 and the coating beam 31 during a second coating pass. In this connection, the first angle $\alpha$ and the second angle $\beta$ are formed in opposite directions relative to the first stack opening surface 111.

It is understood that the previously described embodiments of the invention can, depending on the application, also be combined in any suitable form and that the embodiments described part of this application are only to be understood by way of example.

What is claimed is:

1. A method for the thermal coating of a component stack including a plurality of components, wherein each of the components has a continuous component opening having an inner peripheral surface and the plurality of components are aligned with respect to a stack axis such that the component stack has a continuous stack opening, wherein the stack opening includes a first stack opening surface and a second stack opening surface, and the first stack opening surface and the second stack opening surface are arranged along the stack axis, said method comprising:

coating the inner peripheral surface of each of the plurality of components of the component stack by using a thermal spray apparatus;

said coating comprising:

making a first coating pass through the component stack with a coating beam of the thermal spray apparatus at a first angle ($\alpha$) between the first stack opening surface and the coating beam of the first coating pass;

making a second coating pass through the component stack with a coating beam of the thermal spray apparatus at a second angle ($\beta$) between the first stack opening surface and the coating beam of the second coating pass; and the first angle ($\alpha$) and the second angle ($\beta$) being formed in opposite directions in relation to the first stack opening surface, wherein each of the angle ($\alpha$) and the angle ($\beta$) is greater than 0 degrees and less than or equal to 30 degrees.

2. A method in accordance with claim 1, wherein:

after the first coating pass, and before the second coating pass, the method further comprises rotating the component stack about a first pivot at the stack axis to thereby arrange the first stack opening surface and the second stack opening surface oppositely in relation to the stack axis and thereby forming the second angle ($\beta$) between the first stack opening surface and the coating beam of the second coating pass.

3. A method in accordance with claim 1, wherein:

after the first coating pass, and before the second coating pass, the method further comprises rotating the thermal spray apparatus about a second pivot at the stack axis and thereby forming the second angle ($\beta$) between the first stack opening surface and the coating beam of the second coating pass is formed in such a manner that the thermal spray apparatus is rotated about a second pivot at the stack axis after the first coating pass.

4. A method in accordance with claim 1, wherein:

the thermal spray apparatus is guided through the first stack opening surface during the first coating pass and during the second coating pass.

5. A method in accordance with claim 1, wherein:

the thermal spray apparatus is a first thermal spray apparatus, the method further comprises using a second thermal spray apparatus;

the first thermal spray apparatus comprises the coating beam of the first coating pass and the second thermal spray apparatus comprises the coating beam of the second coating pass; and the first coating pass and the second coating pass take place simultaneously.

6. A method in accordance with claim 1, wherein:

an inner cross-section of the inner peripheral surface of each of the openings of the plurality of components is non-uniform along a stack axis.

7. A method in accordance with claim 1, wherein:

the component stack is rotated about the stack axis during each of the first and second coating passes and/or the thermal spray apparatus is rotated.

8. A method in accordance with claim 1, wherein:

each of the plurality of components is a bearing component and/or the inner peripheral surface of each of the plurality of components is configured as a component seat surface.

9. A method in accordance with claim 1, wherein:

the component stack is arranged on a holder.

10. A method in accordance with claim 1, wherein:

a respective spacer is provided between successive pairs of the plurality of components of the component stack such that the components are arranged spaced apart.

11. A method in accordance with claim 1, wherein:

the angle ($\alpha$) and the angle ($\beta$) amount to between 5 and 15 degrees.

12. A method in accordance with claim 1, wherein:

an inner cross-section of the inner peripheral surface of each opening of the plurality of components is convexly curved along the stack axis.

13. A method in accordance with claim 12, wherein:

a respective spacer is provided between successive pairs of the plurality of components of the component stack such that the components are arranged spaced apart.

14. A method in accordance with claim 1, wherein:

each of the plurality of components is a connecting rod configured for an internal combustion engine; and the inner peripheral surface of each of the plurality of components is configured to house a crankshaft of an internal combustion engine.

15. A method in accordance with claim 1, wherein:

the first angle ($\alpha$) is constant during the first coating pass; and the second angle ($\beta$) is constant during the second coating pass.

* * * * *